United States Patent [19]

Goller et al.

[11] Patent Number: 4,774,819

[45] Date of Patent: Oct. 4, 1988

[54] FLAT KNITTING MACHINE WITH DATA PROCESSING APPARATUS

[75] Inventors: Ernst Goller, Reutlingen; Juergen Ploppa, Pfullingen, both of Fed. Rep. of Germany

[73] Assignee: H. Stoll GmbH & Co., Reutlingen, Fed. Rep. of Germany

[21] Appl. No.: 141,769

[22] Filed: Jan. 11, 1988

[30] Foreign Application Priority Data

Jan. 24, 1987 [DE] Fed. Rep. of Germany ..... 3702050

[51] Int. Cl.[4] ..... D04B 7/00

[52] U.S. Cl. ..... 66/75.2

[58] Field of Search ..... 66/75.2, 70, 71, 128, 66/126 R

[56] References Cited

U.S. PATENT DOCUMENTS

| | | | |
|---|---|---|---|
| 3,783,642 | 1/1974 | Hadam et al. | 66/75.2 |
| 4,354,363 | 10/1982 | Inoue | 66/128 |
| 4,724,686 | 2/1988 | Koike | 66/75.2 |

*Primary Examiner*—Ronald Feldbaum

*Attorney, Agent, or Firm*—Larson and Taylor

[57] ABSTRACT

Data processing apparatus for a flat knitting machine having several cam systems usable in both travel directions and having needles or needle jacks disengageable from the cam tracks of the cam systems, contains an optimisation circuit (15) with at least one microprocessor, with which circuit is achieved, with the data available from several store areas (16–20), whatever is the optimal limitation of the carriage stroke and at the same time an adjustment and pre-adjustment of the yarn guides (24) corresponding thereto, via thread guide carriers.

4 Claims, 1 Drawing Sheet

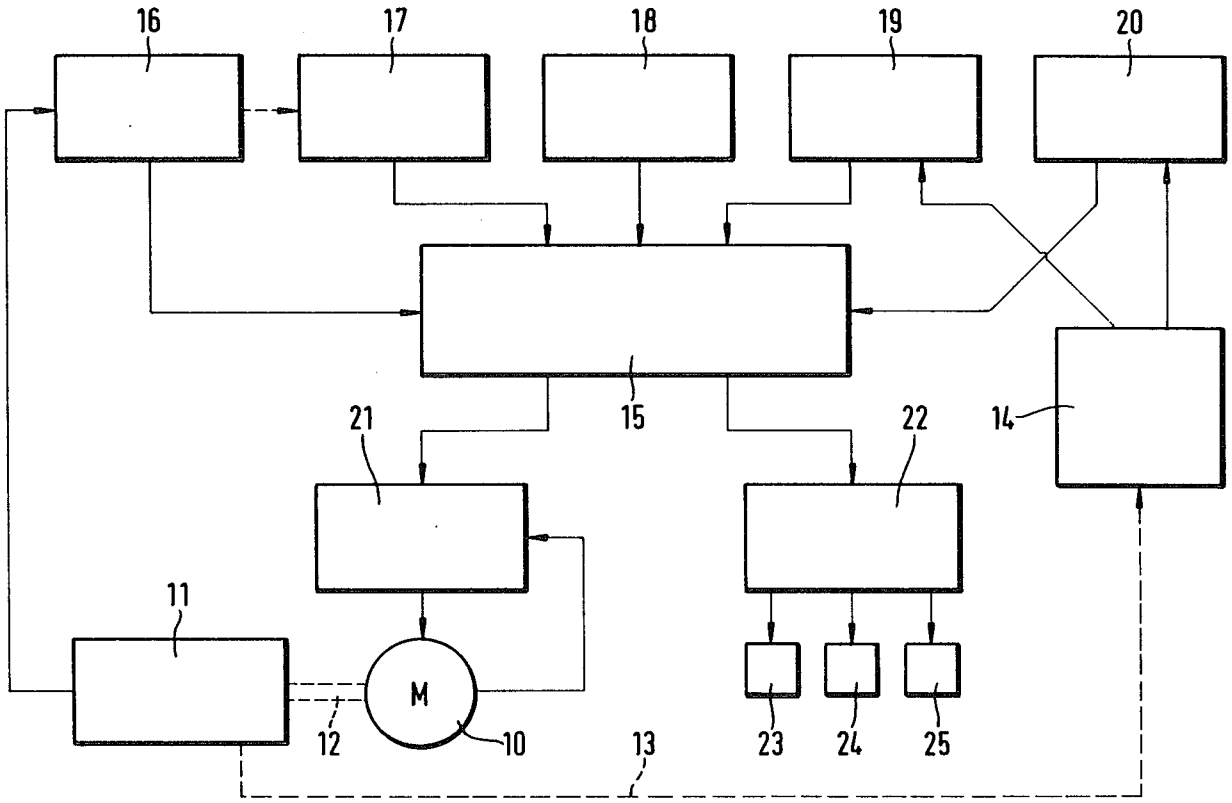
16
17
18
19
20
21
22
23
24
25
M
10
11
12
13
14
15

FLAT KNITTING MACHINE WITH DATA PROCESSING APPARATUS

DESCRIPTION

The invention relates to a flat knitting machine with a carriage having several cam systems usable in both directions of travel; with needles or needle jacks disengageable from the cam tracks of the cam systems; with a needle selection system having at least one needle selection point for each cam system and for each direction of travel; with electro-mechanically actuated carriers for the yarn guides; and with a control arrangement having a data processing unit coupled with a knitting programme memory and with a carriage position indicator and with whose output side are connected the needle selection system, the carriers for the yarn guides and a needle racking arrangement.

Flat knitting machines with the above-described features are known partly from German patent application No. P 34 06 870.8 and partly from German patent application No. P 36 06 821.7 of the applicants. They have the advantage that their cam systems can be used in both directions of travel of the carriage and the needles or needle jacks can be stopped by disengagement from the cam tracks at any desired cam track position indicated by a needle selection point; and also that the thread guides can be positioned, by the carriers arranged on the carriage, at any point in the carriage stroke range. The invention sets out, in a flat knitting machine of this kind with the features mentioned in the introduction, to construct the data processing apparatus in such a way that, in order to increase productivity of the flat knitting machine, the carriage describes, when forming a row of stitches, only the smallest possible stroke path needed to carry out the knitting programme.

The problem is solved by the invention with this flat knitting machine in that the data processing apparatus has at least one microprocessor which is effective as an optimisation circuit and with which are associated several store ideas which contain values taken from the machine for carriage position, carriage travel direction and the position of the individual yarn guides, and values which can be read from the knitting programme memory for fabric width, for needle bed racking, for the stitch row to be produced at the time, for the next stitch row and at least for the next but one stitch row.

In a flat knitting machine constructed according to the invention, the current data which are important for optimising the carriage stroke are always made available in the data processing apparatus, to the microprocessor (effective as an optimisation circuit) in the store areas, and it is advantageous if the store areas can be divided into main and secondary store areas. In this way it is possible to reduce to the shortest possible stroke, for each row of stitches, the movement of the carriage coupled with a reversible motor; which has hitherto not been possible. Stroke limiting arrangements of hitherto known flat knitting machines have permitted only stepwise limitation of the carriage stroke and the carriage has practically always moved over a whole row of needle steps beyond the necessary travel path. The invention, on the other hand, achieves a minimum of carriage movement by various means, one of which is that the cam systems in the plurality of cam systems can be selected with a view to the smallest possible carriage movement. For this purpose the microprocessor acting as an optimisation circuit can give output signals regarding carriage travel path, individual cam systems and individual yarn guide carriers to the effect that the cam system or systems selected is or are always that or those whose use will give, in view of the current position of the carriage, the smallest carriage displacement path when forming at least two consecutive stitch rows. It is advantageous if the output signals from the microprocessor which affect the yarn guide carriers are supplied to the effect that in one carriage stroke at least one yarn guide is carried along into a starting position more favourable for forming a subsequent stitch row, i.e. precautionary displacement movements are carried out by yarn guides.

The increase in productivity which can be achieved with a flat knitting machine according to the invention is considerable. The invention means that, in shaped knitting, narrow fabric sections are produced more quickly than wide ones, which means that the productivity of flat knitting machines with short needle beds compares very favourably with the long-bed flat knitting machines normally used today.

The following is a description of an embodiment of a data processing apparatus according to the invention, referring to the enclosed block wiring diagram which shows the parts of the data processing apparatus most important for the invention.

The block wiring diagram shows the reversible drive motor 10 for the carriage of the flat knitting machine on which, in a known way, a carriage movement indicator 11 is arranged which gives signals for the data processing apparatus, which indicate, or make it possible to ascertain, the current position of the carriage and its movement direction. The double dotted line 12 represents the coupling of the carriage movement indicator 11 with the carriage drive motor 10. The dotted line of action 13 indicates an indirect coupling of the carriage movement indicator 11 with a knitting programme memory 14 of the data processing apparatus, in which are stored data which is important for a certain fabric, its stitch structure and its patterning.

The essential part of the new data processing apparatus is an optimisation circuit consisting of at least one microprocessor and operative according to a preselected programme. It has been decided not to show keyboards which are normally associated with the knitting programme memory 14 for the purpose of varying data and which can also be associated with the optimisation circuit for programme variation. In the data processing apparatus, various store areas are associated with the optimisation circuit 15, from which the current data necessary for optimising the carriage movement are always available to the optimisation circuit 15. These are, in particular, a carriage position store area 16, a carriage direction store area 17, a store area 18 for machine parameters, a knitting pattern store area 19 and a knitting shape store area 20. The store areas can be integrated into the microprocessor or microprocessors of the optimisation circuit 15. The store areas 16 and 17 for carriage position and direction receive their current data from the carriage movement indicator 11. The machine parameters in the store area 18 are machine-specific and relate in particular to the number of working systems present, the arrangement of these working systems and the number and arrangement of the yarn guides. The store areas 19 and 20 for knitting pattern and shape receive their data from the knitting programme memory 14. Both can be multi-layer store areas in which the data for several stitch rows are available to the optimisation circuit at the same time.

The optimisation circuit 15 supplies on the one hand output signals for the carriage drive motor 10 via an amplifier stage 21. According to these signals the carriage movement is optimally controlled. On the other hand the optimisation circuit 15 supplies, via a final stage circuit 22, output signals for control, adapted to the optimised carriage movement, of the racking arrangement 23 (shown only symbolically by a square); of the carriers 24, arranged on the carriage, for the individual yarn guides; and of the needle selection points 25, also arranged on the carriage, to the plurality of working systems and therefore cam systems of the flat knitting machine.

Of the store areas 16–20, store area 18 for the machine parameters is a main store area.

We claim:

1. Flat knitting machine with a carriage having several cam systems usable in both directions of travel; with the needles or needle jacks disengageable from the cam tracks of the cam systems; with a needle selection system having at least one needle selection point for each cam system and for each direction of travel; with electro-mechanically actuated carriers for the yarn guides; and with a control arrangement having a data processing apparatus coupled with a knitting programme memory and with a carriage position indicator and with whose output side is connected the needle selection system, the carriers for the yarn guides and a needle racking arrangement, characterised in that the data processing apparatus has at least one microprocessor effective as an optimisation circuit (15) with which are associated several store areas (16–20) which contain values taken from the machine for carriage position, carriage travel direction and the position of the individual yarn guides, and values which can be read from the knitting programme memory (14) for fabric width, for needle bed racking, for the stitch row to be produced at the time, for the next stitch row and at least for the next but one stitch row.

2. Flat knitting machine according to claim 1, characterised in that the microprocessor acting as optimisation circuit (15) supplies output signals regarding carriage travel path, individual cam systems and individual yarn guide carriers, to the effect that the cam system or systems selected for use is or are always that or those whose use will give, in view of the current carriage position and yarn guide positions, the smallest displacement path of the carriage coupled with a reversible drive motor, when forming at least two consecutive stitch rows.

3. Flat knitting machine according to claim 1, characterised in that the microprocessor acting as optimisation circuit (15) additionally supplies output signals affecting the yarn guide carriers (24) to the effect that in one carriage stroke at least one yarn guide is carried along into a starting position more favourable for forming a subsequent stitch row.

4. Flat knitting machine according to one of claim 1, characterised in that the store areas (16–20) associated with the microprocessor (15) are divided into main and secondary store areas, a store area (18) for machine parameters counting as one of the main store areas.

* * * * *